US005606916A

United States Patent [19]

Murray

[11] Patent Number: 5,606,916

[45] Date of Patent: Mar. 4, 1997

[54] HOPPER DOOR OPERATING MECHANISM

[75] Inventor: John R. Murray, Findlay, Ohio

[73] Assignee: Difco, Inc., Findlay, Ohio

[21] Appl. No.: 428,666

[22] Filed: Apr. 25, 1995

[51] Int. Cl.[6] ..... B61D 3/00

[52] U.S. Cl. ..... 105/286; 105/240; 105/280; 105/284; 105/299; 298/35 M

[58] Field of Search ..... 105/240, 239, 105/241.2, 286, 250, 252, 280, 284, 304, 306, 294, 241.1, 282.1, 291; 222/504; 298/35 M, 27, 29, 31, 33, 35 R, 36; 74/25, 47, 89, 105; 92/68; 49/326–330

[56] References Cited

U.S. PATENT DOCUMENTS

| | | | |
|---|---|---|---|
| 3,316,859 | 5/1967 | Floehr | 105/241 |
| 4,225,110 | 9/1980 | Akkerman | 92/68 |
| 4,541,294 | 2/1985 | Bormioli | 92/68 |
| 4,759,477 | 7/1988 | Gelinas | 92/68 |
| 4,964,348 | 10/1990 | Flowers et al. . | |
| 5,115,748 | 5/1992 | Westlake . | |
| 5,144,895 | 9/1992 | Murray . | |
| 5,261,333 | 11/1993 | Miller . | |
| 5,275,303 | 1/1994 | Szalai | 49/340 |
| 5,359,942 | 11/1994 | Ward . | |
| 5,402,731 | 4/1995 | Miller . | |

OTHER PUBLICATIONS

Morrison Knudsen Corporation, *Rail Systems Group: Phase VI* (undated).

*Primary Examiner*—Robert J. Oberleitner
*Assistant Examiner*—C. T. Bartz
*Attorney, Agent, or Firm*—Marshall & Melhorn

[57] ABSTRACT

A hopper door operating mechanism includes an arcuate closing plate mounted on an internal shaft pivotably connected to the frame of the hopper door. An operating crank has one end connected to the internal shaft and the other end pivotably connected to a link arm. The link arm has motors pivotably connected at opposite ends of the link arm. The closing plate can be rotated to open the hopper door in either direction depending on the discharge direction. To open and close the closing plate in a first direction, the first motor is operated to move the link arm and rotate the closing plate while the second motor is maintained in a closed position to retain one end of the link arm as a fulcrum point. To open and close the closing plate in the opposite direction, the second motor is operated to move the link arm while the first motor is maintained in a close position to retain end of the link arm as a fulcrum point.

11 Claims, 4 Drawing Sheets

HOPPER DOOR OPERATING MECHANISM

BACKGROUND OF THE INVENTION

A. Field of Invention

The present invention relates to door operating mechanisms and, more particularly to an assembly for operating the hopper doors of a railroad car of the type which may be utilized for the distribution of ballast along a railroad bed.

B. Prior Art

Door operating mechanisms for operating the hopper doors of railroad cars of the hopper type are well known in the art.

One of the problems in the operation of such mechanisms is achieving equal and even distribution of the ballast discharged from the ballast carrying hopper-type railroad cars. Another problem with the known hopper door operating mechanism is controlling the opening and closing of the hopper doors. Many of the known mechanisms are designed to be manually opened and closed which manifests an obvious problem of controlling the extent to which the hopper doors are opened to vary the discharge rate of the ballast during movement of the hopper car over the railroad bed.

One of the most difficult requirements of a hopper door control mechanism is the ability to control a rotational rather than linear open and close motion of the door.

SUMMARY OF THE INVENTION

The present invention has been designed to overcome certain disadvantages of the prior art door operating mechanisms.

It is an object of the present invention to produce a door operating mechanism which may easily and efficiently be opened and closed to effectively monitor the discharge of bulk material therethrough.

Another object of the invention is to produce a door operating mechanism which may be readily attached to existing door systems.

Another object of the invention is to produce a door operating mechanism which may be controlled by remotely positioned control mechanisms.

Another object of the invention is to produce a door operating mechanism which provides certainty of door close positioning as remotely directed.

The above, as well as other objects of the invention, may be achieved by an operating mechanism including a door movable between an open and closed position, a crank arm, a link arm, pivotal connection between the crank arm and a point intermediate the ends of the link arm, a first motor pivotally coupled to the link arm between the pivotal connections and one end of the link arm, and a second motor pivotally coupled to the link arm between the pivotal connection and the other end of the link arm, wherein the pivotal coupling between the first motor and the link arm functions as a fulcrum during the operation of the second motor and the pivotal coupling between the second motor and the link arm functions as a fulcrum during the operation of the first motor.

BRIEF DESCRIPTION OF THE DRAWINGS

Other objects and advantages of the invention will become readily apparent to those skilled in the art upon reading the following detailed description of a preferred embodiment of the invention where considered in the light of the accompanying drawings, in which.

DETAILED DESCRIPTION OF THE PREFERRED EMBODIMENT

Figure 1:
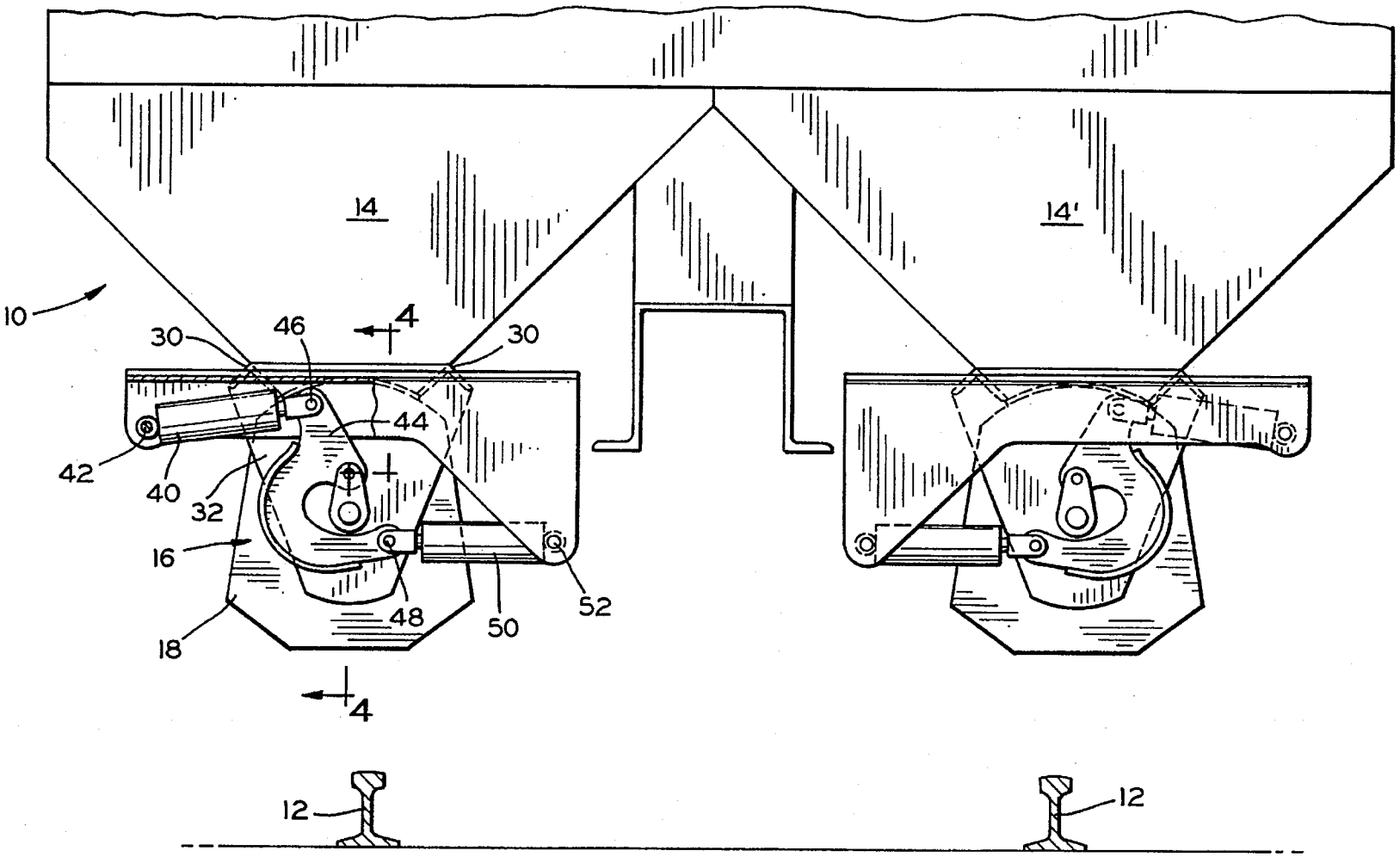
FIG. 1 is a fragmentary sectional view of a hopper type railroad car illustrating two adjacent hoppers each with a door (shown in closed position) and an operating mechanism for each door embodying the features of the present invention.

Referring to the drawings, there is illustrated a railroad car suitable for carrying and discharging bulk material, such as ballast for example, generally identified by referenced numbered 10. The railroad car 10 is provided with suitable wheels, not shown, for travel on associated rails 12. The rails 12 are typically secured to transversely arranged ties which in turn rest on and are supported by a bed of ballast which, from time to time, must be supplemented. The railroad car 10, oftentimes referred to as a hopper car, is capable of carrying bulk ballast material which can be discharged from spaced apart hoppers 14 through respect in hopper doors 16. Each of the hopper doors 16 is comprised of a pair of spaced apart end plates 18, a pair of spaced apart internal discharge plates 20 and 22, an internal shaft 26, and an arcuate closure plate 28 adapted to span to length of the internal plates 20 and 22 and overlap to form ballast shielding lips.

Figure 4:
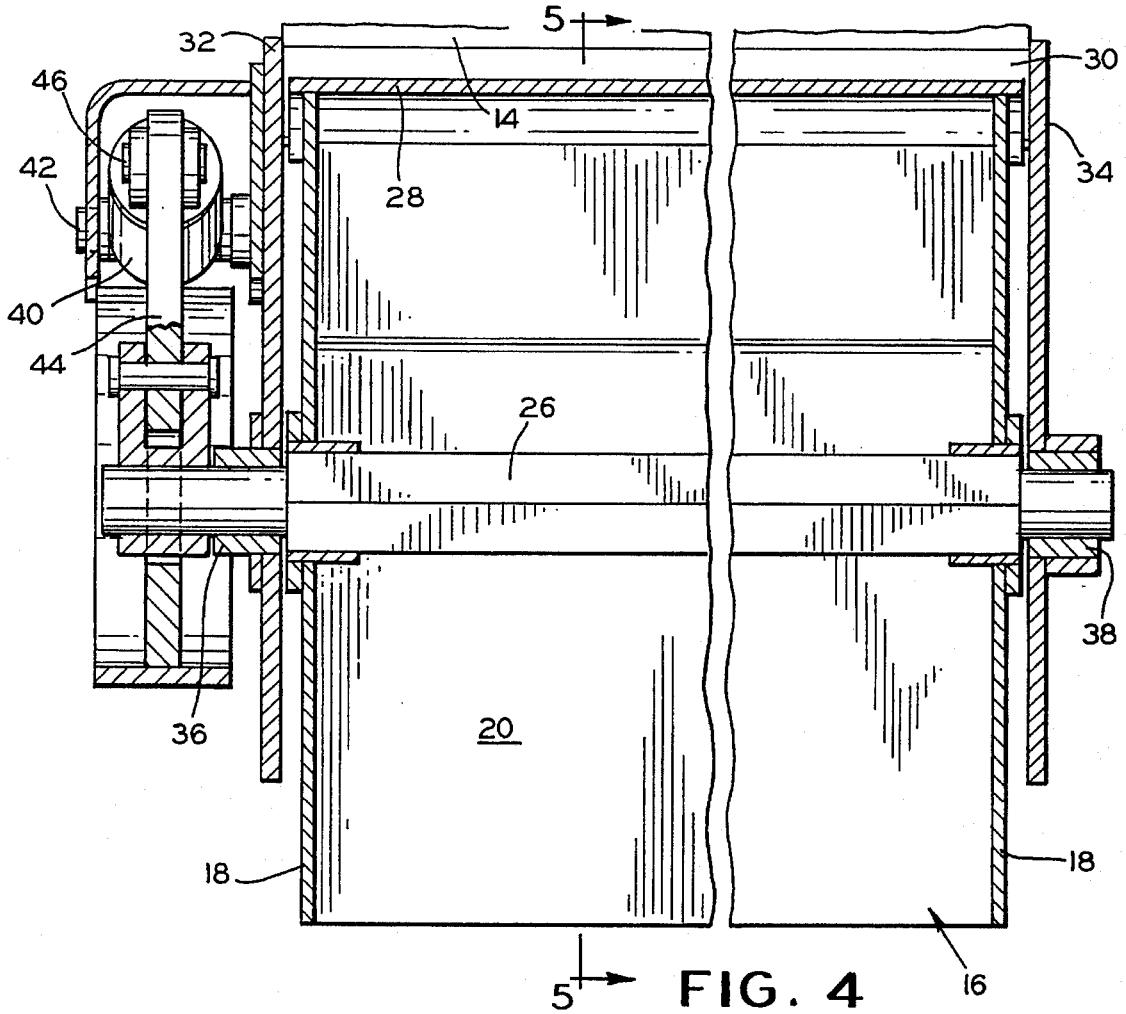
FIG. 4 is an enlarged fragmentary sectional view taken along line 4—4 of FIG. 1.
Figure 5:
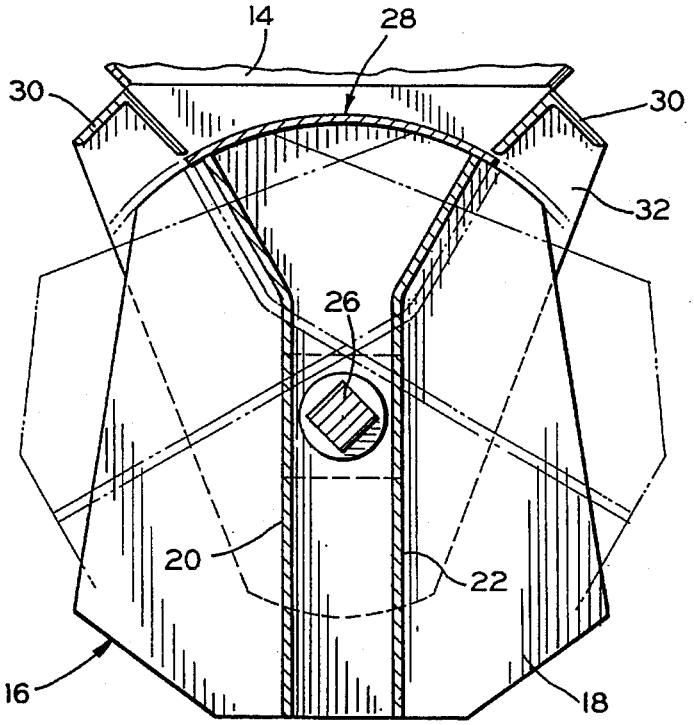
FIG. 5 is a sectional view taken along line 5—5 of FIG. 4.

The lowermost terminus of the hopper 14 may be provided with angle members 30. A pair of spaced apart door supporting frame members 32 and 34 are secured to and depend from the hopper opening. The frame members 32 and 34 are provided with journals 36 and 38, respectively, for rotatably supporting the opposite ends of the closure shaft 26, as clearly illustrated in FIG. 4. It will be noted that the portion of the shaft 26 disposed between the end plates 18 is rectangular in cross-section, while the terminated end portions are cylindrical to enable rotation within the journals 36 and 38 of the depending frame members 32 and 34, respectively.

The essence of the invention resides in the mechanism for opening and closing the hopper doors 16. Since the operating mechanism for each of the hopper doors is substantially identical with the other, only a single mechanism will be described in detail. Corresponding structural elements of the other mechanisms will be designated by corresponding prime reference numerals.

Basically, the operating mechanism includes two pressure fluid operated motors, a partially mounted linkage interconnecting the two motors and, as the preferred embodiment, a crank arm affixed to the closure shaft of the hopper door, and a pivotal attachment for interconnecting the crank to a point of the linkage intermediate the ends thereof.

More specifically, the mechanism includes an upper pressure fluid actuated motor 40 and an associated lower pressure fluid actuated motor 50. One end of the motor 40 is pivotally mounted on the frame member 32 at 44, while the other end, provided with an extensible rod, is pivotally connected to one end of a linkage 44 at 46.

In a similar manner, one end of the lower pressure fluid actuated motor 50 is pivotally mounted on the frame member 32 at 52, while the other end, provided with an extensible rod, is pivotally connected to the opposite end of the linkage 44 at 48.

The linkage 44 is directly connected to the shaft 26 through a crank 54 affixed to the end portion of the shaft. The linkage 44 and the crank 54 are pivotally interconnected at 56.

It will be observed that the linkage 44 is provided with an axial extension 45 along both of the peripheral edges thereof. The extension 45 is employed to militate against the entrance of any bulk material such as ballast, for example, between the moving parts of the mechanism. Extension 45 also functions to stiffen against large loads of ballast material in the hoppers 14.

Normally, the mechanism is in the position illustrated in FIG. 1, wherein the hopper door 16 is in a closed position. Both of the motors 40 and 50 are shown with the respective connecting rods in a retracted position within the motor cylinders.

Figure 2:
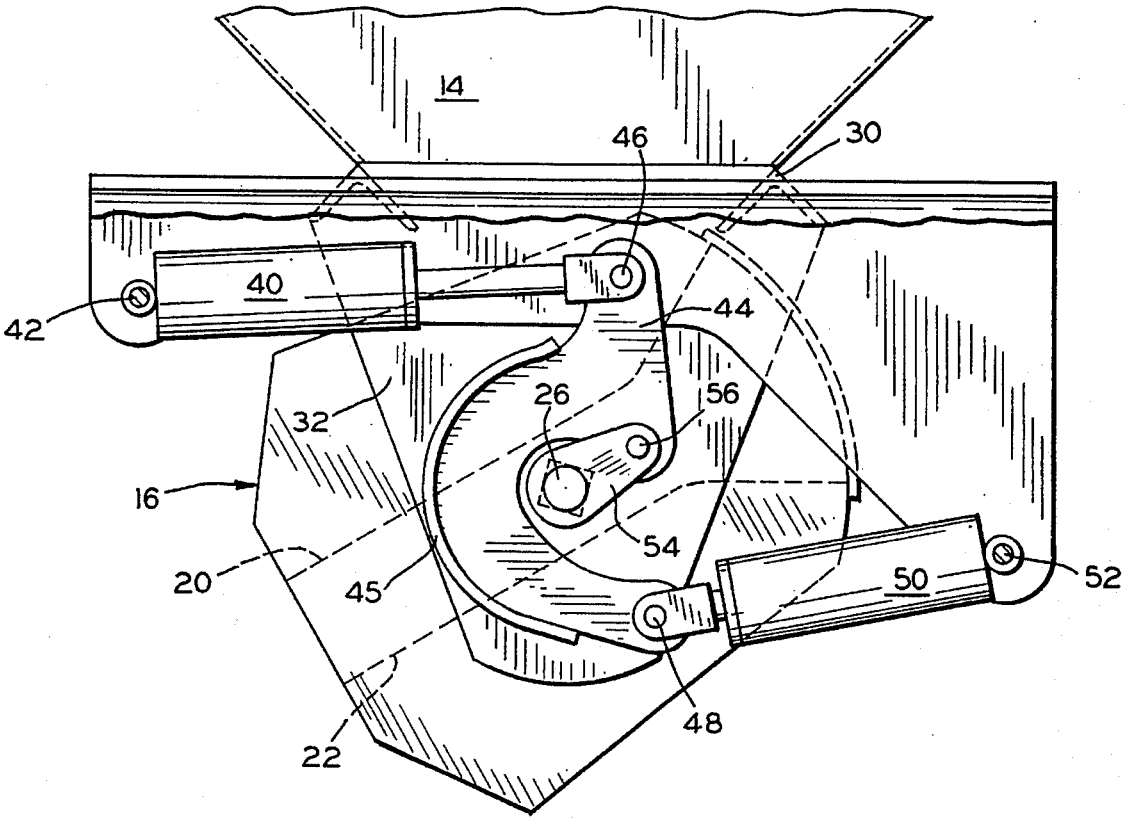
FIG. 2 is an enlarged fragmentary view of the left hand hopper assembly illustrated in FIG. 1 showing the hopper door operating mechanism and associated door in an open position suitable for discharging ballast on the railroad bed on the left hand side of the track member.
Figure 2:
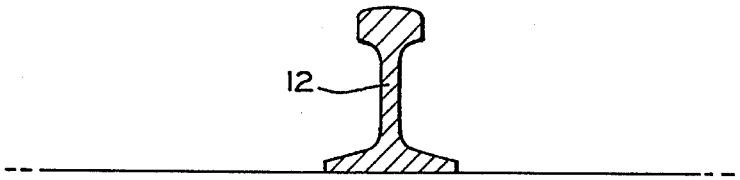

Since all uses of the mechanism require a selective direction from the distribution of the bulk material for the hoppers 14. With particular reference to FIG. 2, the hopper door 16 is shown in a position for directing the discharge of the material from the hoppers 14 to the left hand side of the track 12. In order to move from the closed position illustrated in FIG. 1, the rotation of the hopper door 16 is achieved by applying pressure fluid to the motor 40 to effect movement of the interior piston and associated rod to extend the same to the position illustrated in FIG. 2.

Simultaneously, with the actuation of the motor 40, the motor 50 is caused to be held or maintained in the retracted position. The extension of the rod of the motor 40 causes the linkage 44 to swing about the fulcrum point of the pivotal connection 48, and a contemporaneous rotation of the crank 54 and the associated shaft 26. As the shaft 26 moves in a clockwise direction, the associated hopper door 16 is rotated from the position illustrated in FIG. 1 to the position illustrated in FIG. 2. It will be understood that the hopper door 16 may be rotated to a fully open position completely opening the outlet of the associated hopper 14. Thus, providing for a maximum discharge of the bulk material from the hopper 14 to the track bed on the left hand side of the track 12. Alternatively, the actuation of the motor 40 may be stopped at any point between fully closed and fully open by properly metering the flow of pressure fluid to the motor. Thereby, the control of the quantity of discharge flow from the hopper 14 can be controlled effectively.

Figure 3:
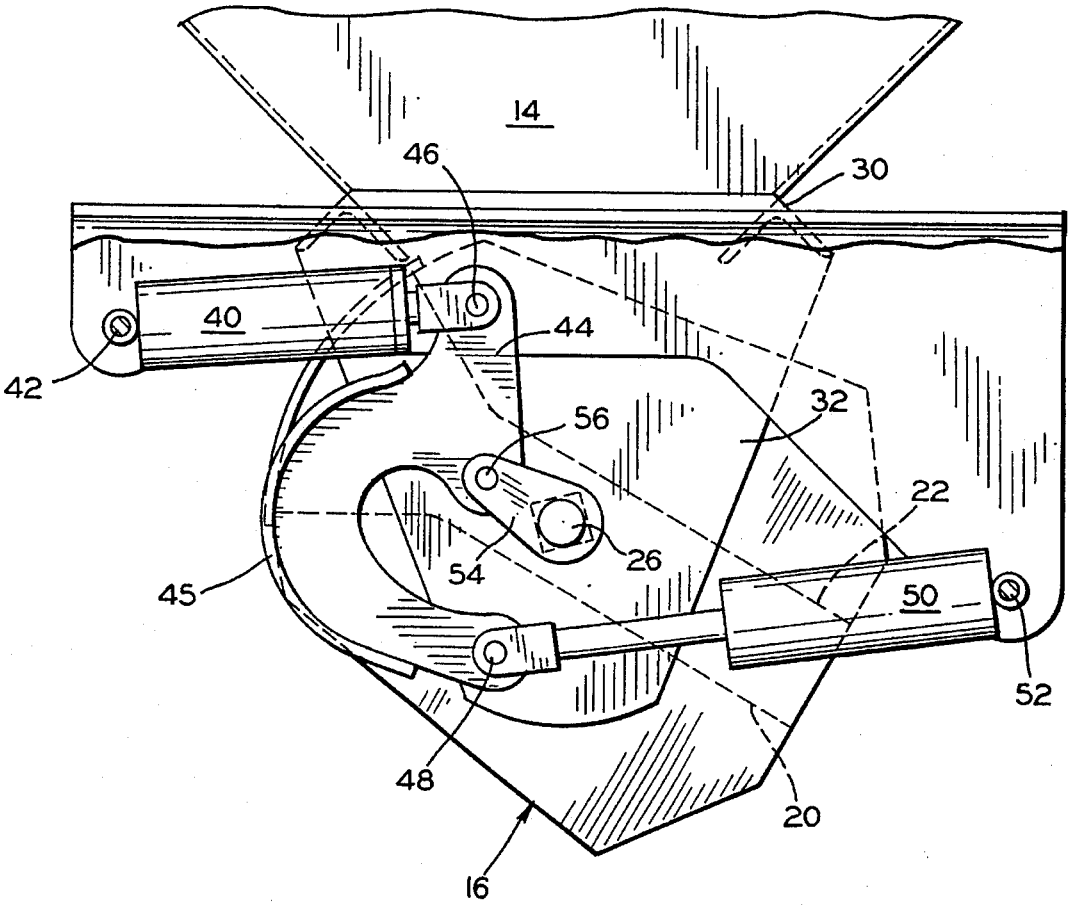
FIG. 3 is an enlarged fragmenting view of the left hand hopper assembly illustrated in FIGS. 1 and 2 showing the hopper door operating mechanism and associated door in an open position suitable for discharging ballast on the railroad bed on the right hand side of the track member.
Figure 3:
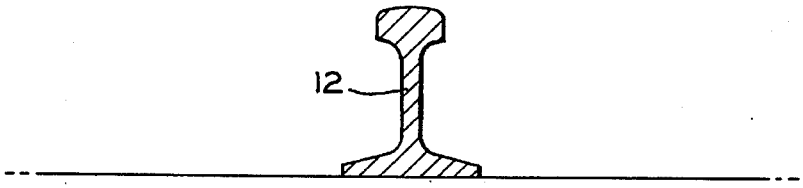

In order to cause the hopper door 16 to move from an open to a closed position, the above energization of motor 40 is reversed. More specifically, the motor 40 is energized to maintain in the position illustrated in FIG. 3 to retract the rod that was extended to open the door and return to the position illustrated in FIG. 1. During this closing, the motor 50 is held in the same closed position as for the door opening since it is the rotational fulcrum for this open/close direction.

In order to open the door 16 in the opposite direction, the activation of the motors is reversed. The motor 40 is activated to remain in the retracted or closed position. The motor 50 is energized by introducing a pressure fluid into the cylinder causing the internal piston and the associated rod to move to the position illustrated in FIG. 3. It will be appreciated that the operation is similar to that described above in respect of the description of FIG. 2 with the difference that in the operation illustrated in FIG. 3, the linkage 44 is caused to swing about the fulcrum established by the pivotal connection 46. During the movement of the linkage 44 about the pivot 46, the bell crank 54 is caused to move in a counterclockwise direction, simultaneously rotating the shaft 26 and the hopper door 16 to a position to direct the discharge of the bulk material from the hopper 14 to the right hand side of the track 12.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A hopper door operating mechanism for rotatably moving a hopper door to selectively open and close a discharge opening of a hopper car, said hopper door operating mechanism comprising:

a) a pair of spaced apart support members mounted on opposite sides of a discharge opening of a hopper car;

b) a hopper door mounted between said support members, said hopper door including a shaft rotatably connected to said support members and extending across the discharge opening, and including a closure plate mounted on the shaft such that the closure plate closes the discharge opening;

c) an operating crank connected to one end of the shaft of the hopper door;

d) a link arm, said link arm including a pivotable connection at an intermediate point on said link arm which connects said operating crank to said link arm;

e) a first motor mounted on a support member and coupled to said link arm between the pivotable connection and a first end of said link arm, and f) a second motor mounted on the support member and coupled to said link arm between the pivotal connection and a second end of said link arm, whereby said first and second motors and said closure plate are arranged in a manner that when said first motor is operated and said second motor is retained in a closed position, the closure plate is rotatably moved to one side of the discharge opening, and, when said second motor is operated and said first motor is retained in a closed position, the closure plate is rotatably moved to the opposite side of the discharge opening.

2. The operating mechanism defined in claim 1 wherein said first and second motors are pressure fluid operated.

3. The operating mechanism defined in claim 2 wherein said each of motors includes an extensible piston which extends transversely to the shaft of said hopper door.

4. The operating mechanism defined in claim 1 wherein said first and second motors are hydraulic motors.

5. The operating mechanism defined in claim 1 wherein said operating crank is a bell crank.

6. The operating mechanism defined in claim 1 wherein said link arm is a curved arm mounted about one end of the shaft of said hopper door.

7. The operating mechanism defined in claim 1 wherein the closure plate of said hopper door is an arcuate plate.

8. The operating mechanism defined in claim 1 wherein said hopper door includes a pair of discharge plates positioned in spaced-apart relationship on opposite sides of the shaft, said discharge plates extending along opposite longitudinal edges of the closure plate and connecting to the shaft of said hopper door.

9. The operating mechanism defined in claim 1 wherein the closure plate of said hopper door includes an axial extension at both ends of the closure plate.

10. A hopper door operating mechanism for selectively opening and closing a hopper door at a discharge opening of a hopper car by rotatably positioning a shaft-mounted closure plate, said hopper door operating mechanism comprising:

a) a pair of spaced apart support members mounted on opposite sides of a discharge opening of a hopper car;

b) an operating crank connected to one end of a shaft of a hopper door mounted between said support members;

c) a link arm, said link arm including a pivotable connection at an intermediate point on said link arm which connects said operating crank to said link arm;

d) a first motor mounted on a support member and coupled to said link arm between the pivotable connection and a first end of said link arm; and a second motor mounted on the support member and coupled to said link arm between the pivotal connection and a second end of said link arm, whereby said first and second motors and said closure plate are arranged in a manner that when said first motor is operated and said second motor is retained in a closed position, the closure plate is rotatably moved to the opposite side of the discharge opening.

11. A hopper door operating mechanism for rotatably moving a hopper door to selectively open and close a discharge opening of a hopper car, said hopper door operating mechanism comprising:

a) a pair of spaced apart support members mounted on opposite sides and extending downwardly from a discharge opening of a hopper car;

b) a hopper door mounted between said support members, said hopper door including a shaft rotatably connected to said support members and extending across the discharge opening, and including a closure plate mounted on the shaft such that the closure plate closes the discharge opening, and a pair of discharge plates extending longitudinally on opposite sides of the shaft;

c) an operating bell crank connected to one end of the shaft of the hopper door;

d) a curved link arm, said link arm including a pivotable connection at an intermediate point on said link arm which connects said operating crank to said link arm;

e) a first motor mounted on a support member and coupled to said link arm between the pivotable connection and a first end of said link arm; and a second motor mounted on the support member and coupled to said link arm between the pivotal connection and a second end of said link arm, whereby said first and second motors and said closure plate are arranged in a manner that when said first motor is operated and said second motor is retained in a closed position, the closure plate is rotatably moved to one side of the discharge opening, and, when said second motor is operated and said first motor is retained in a closed position, the closure plate is rotatably moved to the opposite side of the discharge opening.

* * * * *